US011744761B2

(12) United States Patent
Park et al.

(10) Patent No.: US 11,744,761 B2
(45) Date of Patent: Sep. 5, 2023

(54) EXERCISE APPARATUS FOR LUMBAR STABILIZATION

(71) Applicant: SEOUL NATIONAL UNIVERSITY R&DB FOUNDATION, Seoul (KR)

(72) Inventors: Jae Heung Park, Gyeonggi-do (KR); Won Je Choi, Gyeonggi-do (KR); Jong Seok Won, Gyeonggi-do (KR); Hyun Bum Cho, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 953 days.

(21) Appl. No.: 16/617,020

(22) PCT Filed: May 24, 2018

(86) PCT No.: PCT/KR2018/005889
§ 371 (c)(1),
(2) Date: Nov. 26, 2019

(87) PCT Pub. No.: WO2018/217028
PCT Pub. Date: Nov. 29, 2018

(65) Prior Publication Data

US 2021/0137764 A1 May 13, 2021

(30) Foreign Application Priority Data

May 26, 2017 (KR) ..... 10-2017-0065485

(51) Int. Cl.
*A61H 1/02* (2006.01)
*A61H 1/00* (2006.01)

(52) U.S. Cl.
CPC ..... *A61H 1/0229* (2013.01); *A61H 1/005* (2013.01); *A61H 2201/1669* (2013.01);
(Continued)

(58) Field of Classification Search
CPC ..... A47C 1/022; A47C 1/0242; A47C 17/175; A47C 1/028; A47C 17/74; A47C 17/70; A47C 17/32; A61G 5/1081; A61G 7/165; A47D 1/06; A61H 1/001–003; A61H 1/0005–006; A61H 1/008; A61H 1/0229;
(Continued)

(56) References Cited

U.S. PATENT DOCUMENTS 3,636,946 A * 1/1972 Hardy ..... A63B 21/04 601/134
4,865,303 A * 9/1989 Hall ..... A61G 13/04 5/618
(Continued)

FOREIGN PATENT DOCUMENTS

KR 200302525 Y1 1/2003
KR 200349879 Y1 5/2004
(Continued)

*Primary Examiner* — Justine R Yu
*Assistant Examiner* — Alexander Morales
(74) *Attorney, Agent, or Firm* — Dilworth IP, LLC

(57) ABSTRACT

An exercise apparatus for lumbar stabilization, which includes a first sub-antigravity module configured to apply a predetermined force to an upper body, and a base frame including a first rotating plate configured to support the first sub-antigravity module to be rotatable about a first vertical rotary shaft extending vertically.

11 Claims, 6 Drawing Sheets

(52) U.S. Cl.
CPC ..... *A61H 2201/1671* (2013.01); *A61H 2201/5064* (2013.01); *A61H 2203/0456* (2013.01); *A61H 2203/0468* (2013.01); *A61H 2203/0475* (2013.01)

(58) Field of Classification Search
CPC ..... A61H 1/0292; A61H 2201/0138; A61H 2201/1623; A61H 2205/081; A63B 21/00; A63B 21/00181; A63B 23/0238
USPC ..... 482/73
See application file for complete search history.

(56) References Cited

U.S. PATENT DOCUMENTS 5,141,483 A 8/1992 Smith
5,282,835 A * 2/1994 Wright ..... A61H 1/0292 601/24
5,630,790 A * 5/1997 Ito ..... A61H 1/00 601/102
5,676,601 A * 10/1997 Saunders ..... A63G 1/32 472/3
7,914,471 B2 * 3/2011 Chen ..... A61H 23/0263 601/99
8,361,000 B2 * 1/2013 Gaspard ..... A61H 7/004 606/1
10,493,309 B2 * 12/2019 Jue ..... A63B 21/00069
2002/0156404 A1 * 10/2002 Kuo ..... A61H 15/0078 601/87

FOREIGN PATENT DOCUMENTS

KR 100555990 B1 3/2006
KR 100847396 B1 7/2008
KR 20110030150 A 3/2011
KR 101246669 B1 3/2013
KR 101402434 B1 6/2014

* cited by examiner

EXERCISE APPARATUS FOR LUMBAR STABILIZATION

FIELD OF THE INVENTION

Exemplary embodiments of the present invention relate to an exercise apparatus for lumbar stabilization.

BACKGROUND OF THE INVENTION

Low back pain is a very serious disease in modern society. According to a 2010 paper analyzing the WHO's statistics, low back pain was selected as the most prevalent disease causing disabilities. A 2014 survey by the Korean Ministry of Health and Welfare reported that low back pain was the second highest prevalence in the group of elderly people.

There are many methods to treat low back pain, but stabilizing the lumbar spine through exercise is known to be the safest in order to preserve the body without surgery.

Among many therapies for such exercise, one of the most scientifically proven exercise methods is a core stabilization exercise that is widely known as core exercise.

However, the core exercise is mainly developed for injuries of the athletes who has the basic physical ability surpassing that of the general public, rather than for physically vulnerable patients such as elderly patients, obese patients, or patients with upper or lower limb disability. Hence, it is difficult to apply the core exercise directly to the physically vulnerable patients.

The related art described above is technical information possessed by the inventor(s) for the derivation of the embodiments of the present invention or acquired in the derivation process and may not be technology necessarily known to the general public before the application of the embodiments of the present invention.

SUMMARY OF THE INVENTION

Technical Problem

Exemplary embodiments of the present invention are directed to an exercise apparatus for lumbar stabilization, which assists physically vulnerable patients to perform core exercises by themselves for treatment of low back pain.

Technical Solution

In accordance with an aspect of the present invention, there is provided an exercise apparatus for lumbar stabilization, which includes a first sub-antigravity module configured to apply a predetermined force to an upper body, and a base frame including a first rotating plate configured to support the first sub-antigravity module to be rotatable about a first vertical rotary shaft extending vertically.

In the present aspect, the exercise apparatus may further include a second sub-antigravity module configured to apply a predetermined force to a lower body in a direction opposite to gravity, and the base frame may include a second rotating plate configured to support the second sub-antigravity module to be rotatable about a second vertical rotary shaft extending vertically.

In the present aspect, the base frame may include a guide configured to individually support the first and second rotating plates to be movable horizontally.

In the present aspect, each of the first and second sub-antigravity modules may include a cushion configured to support the upper or lower body, a support including a horizontal support rotatably installed on the first or second rotating plate, a vertical support configured to connect the first or second rotating plate and the cushion and linked to the cushion so that the cushion is rotatable about a horizontal rotary shaft extending horizontally, and a connecting support configured to connect the horizontal support and the vertical support, and an elastic actuator configured to connect the first or second rotating plate and the cushion and to apply an antigravity force to the cushion.

In the present aspect, each of the first and second sub-antigravity modules may include a restraint link including a first link configured to connect the cushion and the connecting support and linked, at one end thereof, to the cushion, a second link whose one end is linked to the connecting support while the other end thereof is linked to the other end of the first link, and a third link whose one end is rotatably connected to a first fixed shaft installed on the first or second link while the other end thereof is connected to a second fixed shaft installed on the first or second link, the third link having a guide hole formed to accommodate the second fixed shaft to impart a degree of freedom to the second fixed shaft.

In the present aspect, the horizontal support may include a rotation center part configured to accommodate the first or second vertical rotary shaft, and the horizontal support may rotate with respect to the first or second rotating plate along with the rotation center part rotating about the first or second vertical rotary shaft.

In the present aspect, each of the first and second rotating plates may include a plurality of fixed coupling holes spaced at regular intervals radially about the first or second vertical rotary shaft, and the horizontal support may include a rotation coupling part having a rotation coupling hole corresponding to the plurality of fixed coupling holes, and a rotation fixing pin inserted into the rotation coupling part and an associated one of the fixed coupling holes to limit rotation of the horizontal support relative to the first or second rotating plate.

In the present aspect, the elastic actuator may include a motor configured to provide a driving force for rotating a screw shaft, a nut member coupled to an outer peripheral surface of the screw shaft to be movable along the screw shaft, and linked to the cushion, and an elastic member installed to the nut member to provide a predetermined elastic force between the nut member and the cushion.

In the present aspect, the elastic actuator may further include a first displacement measuring sensor whose one end is installed to the motor while the other end thereof is installed adjacent to a linking position between the nut member and the cushion, to measure a displacement of the elastic actuator.

In the present aspect, the elastic actuator may further include a second displacement measuring sensor installed to the elastic member to measure a displacement of the elastic member.

In the present aspect, the second fixed shaft may be movable between a first position and a second position in the guide hole, when the second fixed shaft is placed at the first position, the cushion may horizontally support the upper or lower body, and when the second fixed shaft is placed at the second position, the cushion may be rotated by a predetermined angle toward the base frame about a position at which the cushion and the vertical support are linked to each other.

In the present aspect, each of the first and second rotating plates may include a horizontal guide part configured to accommodate a rail formed on the side surface of the guide, and the horizontal guide part may be formed to be movable horizontally along the rail.

In the present aspect, the guide may include a plurality of rollers configured to support the base frame to be movable on the ground.

Other aspects, features, and advantages other than those described above will become apparent from the following drawings, claims, and detailed description of the invention.

Advantageous Effects

According to exemplary embodiments of the present invention, it is possible to provide an exercise apparatus for lumbar stabilization, which enables a patient to actively control his/her own body by applying a low load to all muscles associated with lumbar stability.

According to the exemplary embodiments of the present invention, it is possible to precisely and robustly control the external load applied to the muscles of the patient.

According to the exemplary embodiments of the present invention, it is possible to minimize the load applied to the spine and upper and lower limbs of the patient during exercise.

Of course, the scope of the embodiments of the present invention is not limited by these effects.

DETAILED DESCRIPTION OF THE INVENTION

Description of Reference Numerals

Figure 1:
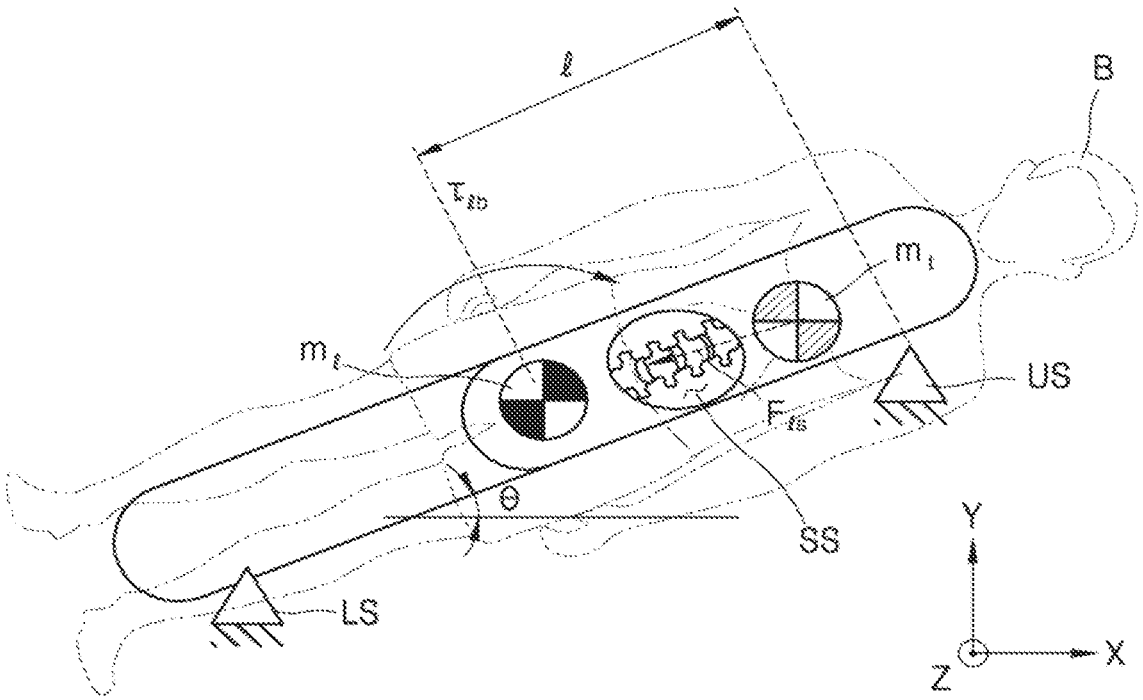
FIG. 1 is a conceptual diagram schematically illustrating static analysis of side-bridge exercise.

100: exercise apparatus for lumbar stabilization, 113*d*, 123*d*: first displacement measuring sensor
110, 120: first and second sub-antigravity modules, 113*e*, 123*e*: second displacement measuring sensor
111, 121: cushion, 114, 124: restraint link
112, 122: support, 114*a*, 124*a*: first link
112*a*, 122*a*: horizontal support, 114*b*, 124*b*: second link
112*a*_1, 122*a*_1: rotation center part, 114*c*, 124*c*: third link
112*a*_2, 122*a*_2: rotation coupling part, 130: base frame
112*a*_3, 122*a*_3: rotation fixing pin, 131: first rotating plate
112*b*, 122*b*: vertical support, 131*a*, 132*a*: fixed coupling hole
112*c*, 122*c*: connecting support, 131*b*, 132*b*: horizontal guide part
113, 123: elastic actuator, 132: second rotating plate
113*a*, 123*a*: motor, 133: guide
113*b*, 123*b*: nut member, 133*a*: roller
113*c*, 123*c*: elastic member

MODE FOR INVENTION

The present invention may be subjected to various modifications and have various embodiments, and specific embodiments will be illustrated in the drawings and described in the detailed description of the present invention. The effects and features of the present invention and the methods for achieving them will be apparent with reference to the embodiments described below in detail in conjunction with the drawings. However, the present invention is not limited to the embodiments disclosed below but may be embodied in different forms.

In the following embodiments, the singular forms "a", "an" and "the" are intended to include the plural forms as well, unless context clearly indicates otherwise. It should be understood that the terms "comprises/includes" and/or "comprising/including" when used in this specification, specify the presence of stated features and/or components thereof, but do not preclude the presence or addition of one or more other features and/or components thereof.

In the drawings, the size of each component may be exaggerated or reduced for convenience of description. For example, since the size and thickness of each component are arbitrarily illustrated in the drawings for convenience of description, the present invention is not necessarily limited thereto.

Reference will now be made in detail to exemplary embodiments of the present invention, examples of which are illustrated in the accompanying drawings. In connection with the drawings, the same or corresponding components will be designated by the same reference numerals and a redundant description thereof will be omitted.

Prior to describing an exercise apparatus for lumbar stabilization 100 according to an embodiment of the present invention, the principle of the exercise apparatus for lumbar stabilization 100 will be roughly described with reference to FIG. 1.

FIG. 1 is a conceptual diagram schematically illustrating static analysis of side-bridge exercise.

Figure 6:
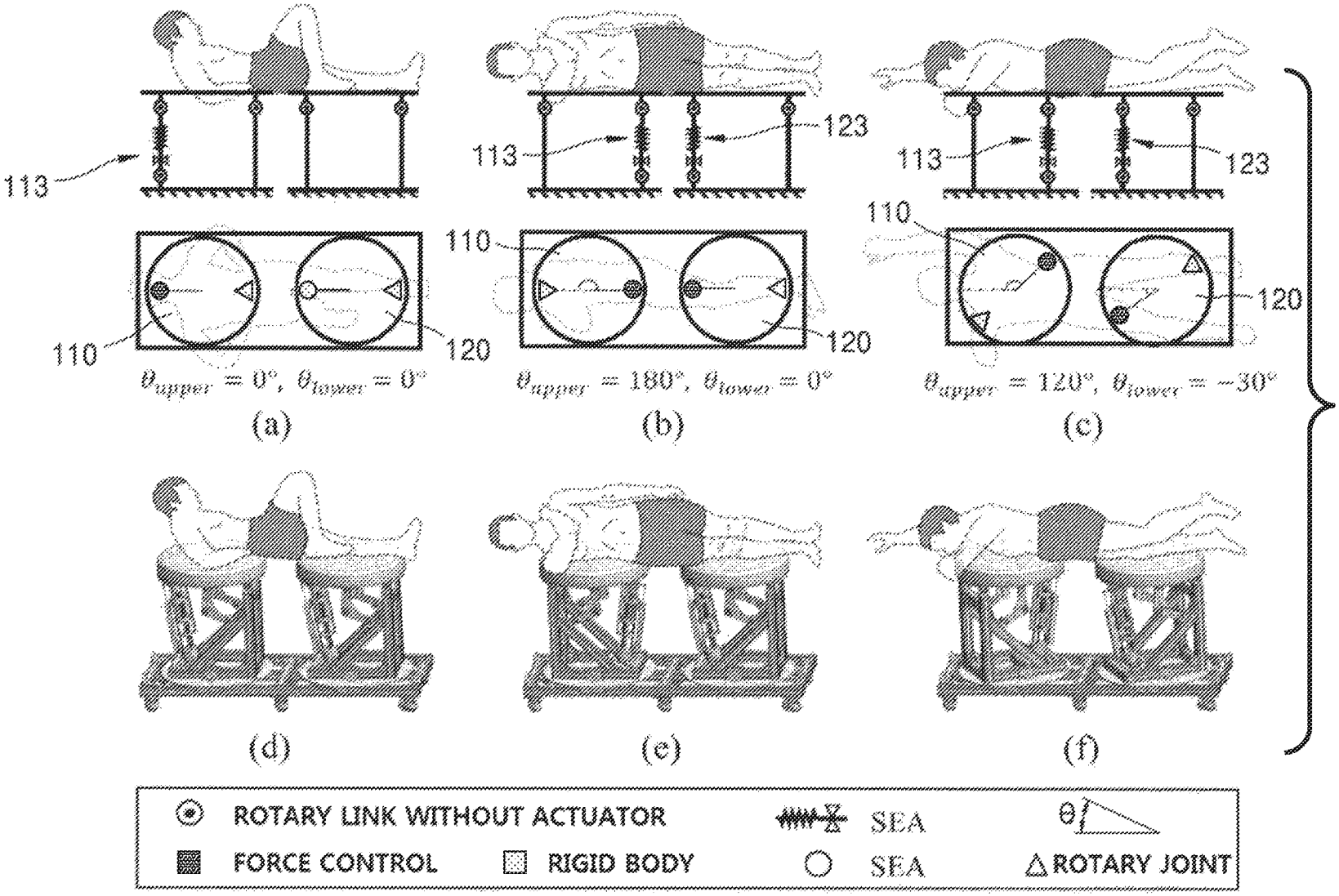
FIG. 6 is a view schematically illustrating types of lumbar stabilization exercises that can be performed using the exercise apparatus for lumbar stabilization according to the embodiment of the present invention.

Here, the term "side-bridge exercise" refers to one of "curl-up" (see (a) and (d) in FIG. 6), "side-bridge" (see (b) and (e) in FIG. 6), and "bird-dog" (see (c) and (f) in FIG. 6), which are widely used, among various exercise postures for lumbar stabilization, because a relatively low load is applied on a person's lower back, especially there is no load applied to his/her spine.

In detail, it is confirmed from previous studies that the above-mentioned three exercise postures contribute to an improvement in lumbar stability by increasing the stiffness of spinal muscles. These three postures may stimulate different specific muscles during exercise for lumbar stabilization.

For example, the curl-up posture may primarily stimulate rectus abdominis. On the other hand, the side-bridge posture may stimulate quadrates lumborum, external oblique, internal oblique, and transverse abdominis. The bird-dog posture may stimulate multifidii, thoracic erector, and lumbar erector.

Since these curl-up, side-bridge, and bird-dog postures may stimulate most of the local and global muscle systems of the lower back, the three exercise postures may be enough to perform exercise for lumbar stabilization. Accordingly, the curl-up, side-bridge, and bird-dog postures will be hereinafter referred to as "big three postures".

However, it may be difficult for certain patients to take the big three postures. That is, the big three postures require physical abilities to be supported for application of a sufficient force to upper and lower bodies since they are a form of weight-bearing exercise. Hence, elderly people with weak muscles, overweight people, or people who are difficult to control the force applied to their bodies due to disabilities may not perform the lumbar stabilization exercise in the big three postures.

Referring to FIG. 1, a torque $\tau_{lb}$ applied to a waist joint (position indicated by reference numeral mi) of a body B may be defined by a distance 1 from the waist joint mi to an upper body support point US, a point mass mi at the waist joint, and an angle θ formed between body links and the ground (see the following Equation 1):

$$\tau_{lb}=l\cdot m_l g\cdot\cos\theta \quad \text{(Equation 1).}$$

In addition, a force $F_{ls}$ applied to a spine SS may be defined as the following Equation 2 when the point mass of an upper body link is $m_t$:

$$F_{ls}=m_t g\cdot\sin\theta \quad \text{(Equation 2).}$$

Referring to the above Equation 1, in order to minimize the torque $\tau_{lb}$ applied to the waist joint mi, there may be a method of adjusting the distance l from the waist joint $m_l$ to the upper body support point US, or a method of adjusting the angle θ formed by the body links and the ground to about 90 degrees. However, the method of adjusting the distance l from the waist joint mi to the upper body support point US may not minutely control the torque $\tau_{lb}$ applied to the waist joint mi since people have different body structures. On the other hand, when the angle θ formed by the body links and the ground is adjusted to about 90 degrees, the torque $\tau_{lb}$ applied to the waist joint $m_l$ may be reduced. However, as shown in Equation 2, when the angle θ formed by the body links and the ground is adjusted to about 90 degrees, the force $F_{ls}$ applied to the spine SS may be increased.

For these reasons, in order to reduce the torque $\tau_{lb}$ applied to the waist joint mi, it is possible to devise a method of applying a force, which is opposite to the force of gravity $m_l g$ generated at the waist joint mi, namely, an antigravity force to the waist joint mi. The exercise apparatus for lumbar stabilization 100 according to the embodiment of the present invention may include a first sub-antigravity module 110 and a second sub-antigravity module 120, more specifically, elastic actuators 113 and 123, which will be described later, to apply the antigravity force to the waist joint $m_l$.

If such an antigravity force $F_{anti\text{-}g}$ is applied to the waist joint mi, the torque $\tau_{lb}$ applied to the waist joint mi may be defined as the following Equation 3:

$$\tau_{lb}=l\cdot(m_l g-F_{anti\text{-}g})\cdot\cos\theta \quad \text{(Equation 3).}$$

Hereinafter, the components of the exercise apparatus for lumbar stabilization 100 according to the embodiment of the present invention and the coupling relationship thereof will be described in detail with reference to FIGS. 2 to 5.

Figure 2:
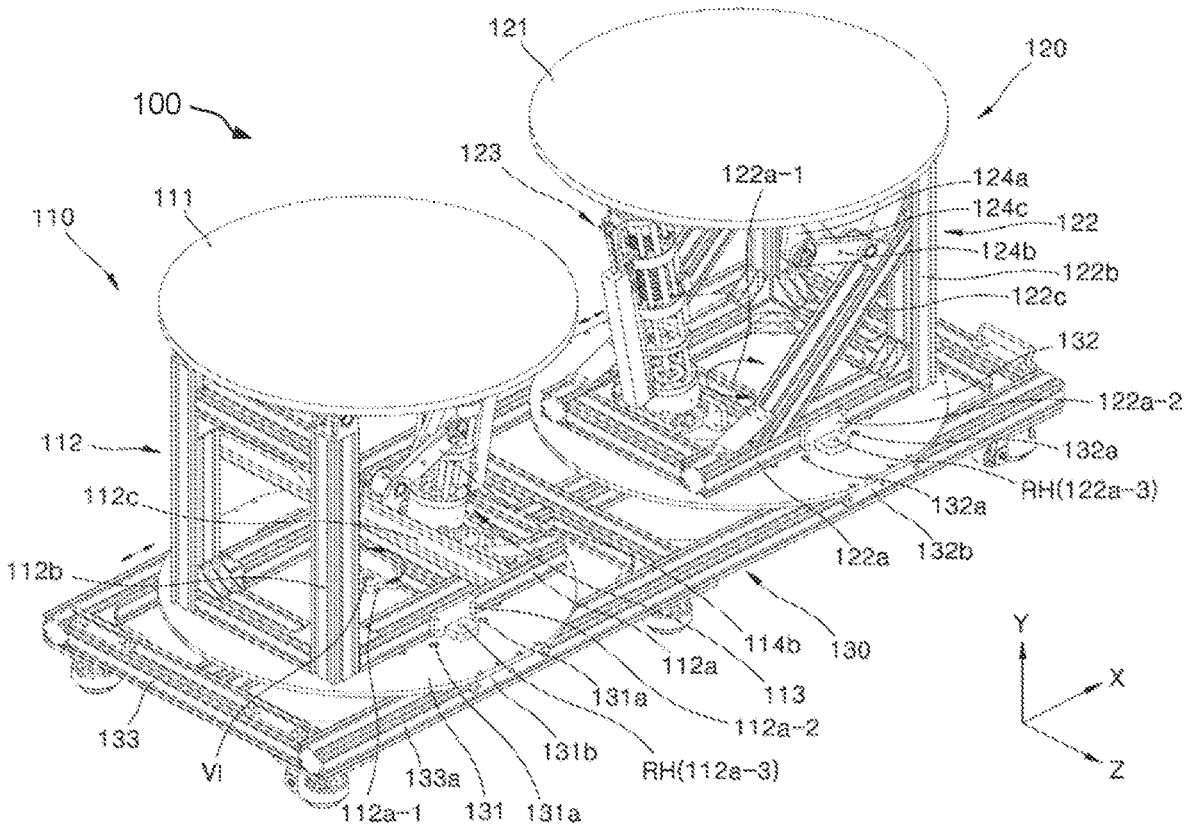
FIG. 2 is a perspective view illustrating an exercise apparatus for lumbar stabilization according to an embodiment of the present invention.
Figure 3:
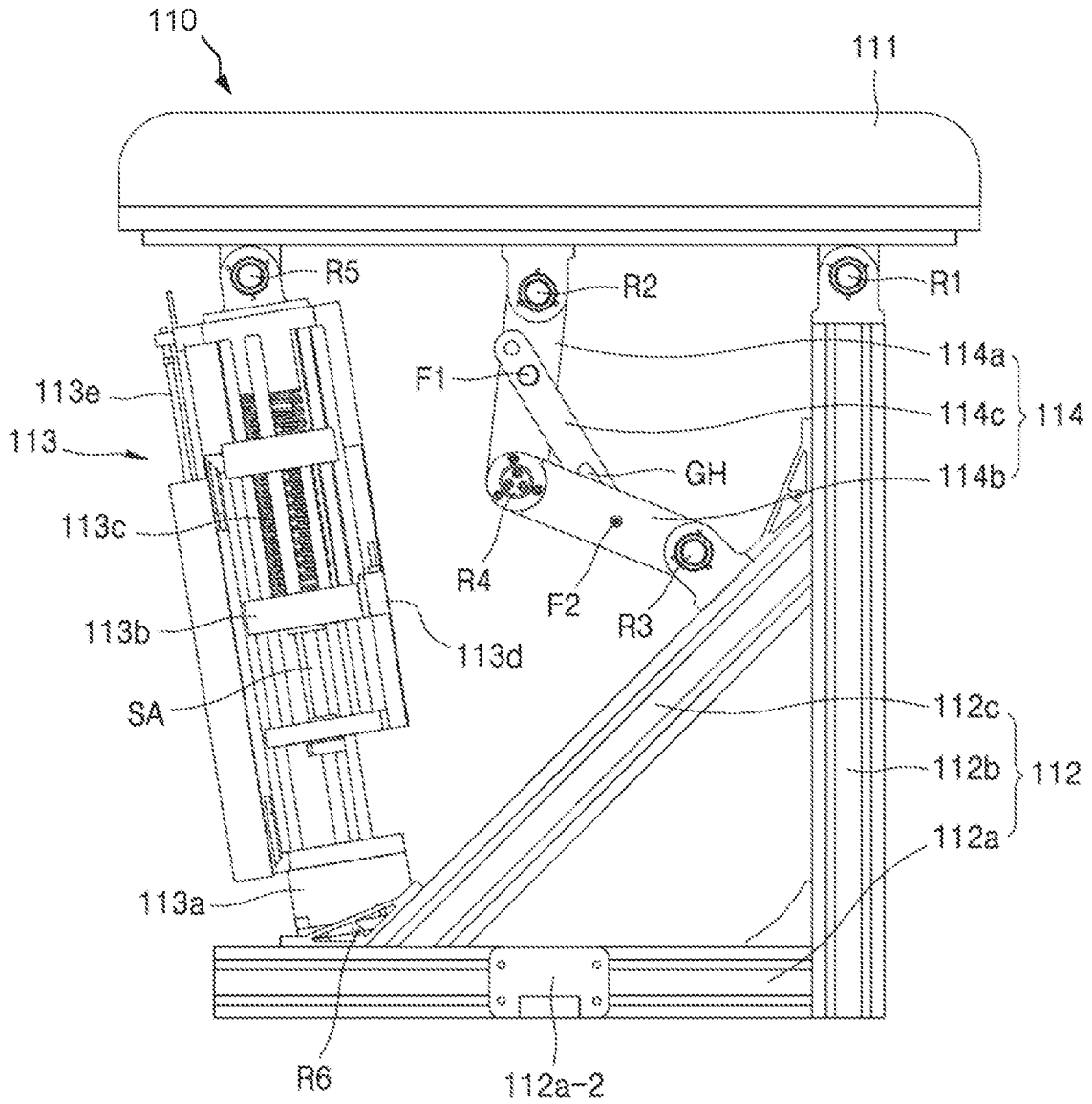
FIG. 3 is a side view illustrating a first sub-antigravity module.
Figure 4A:
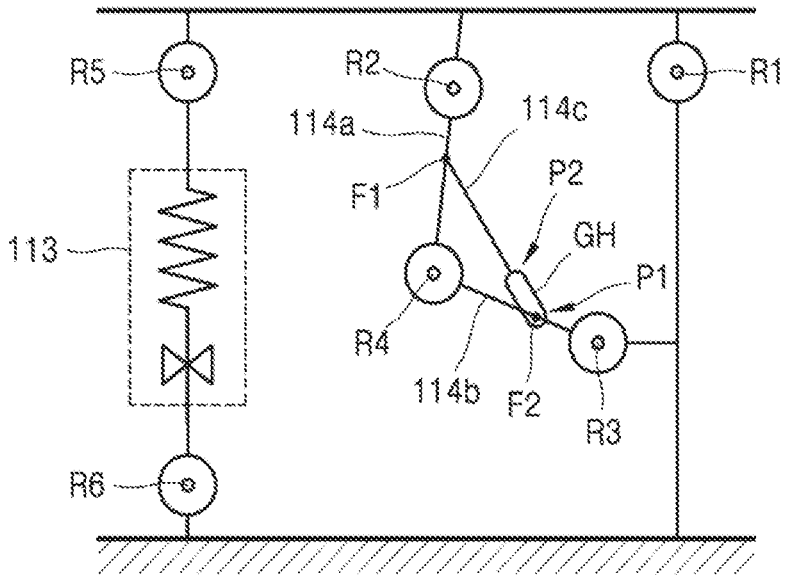
FIGS. 4*a* and 4*b* are simplified conceptual diagrams illustrating an operation of the first sub-antigravity module of FIG. 3.
Figure 4B:
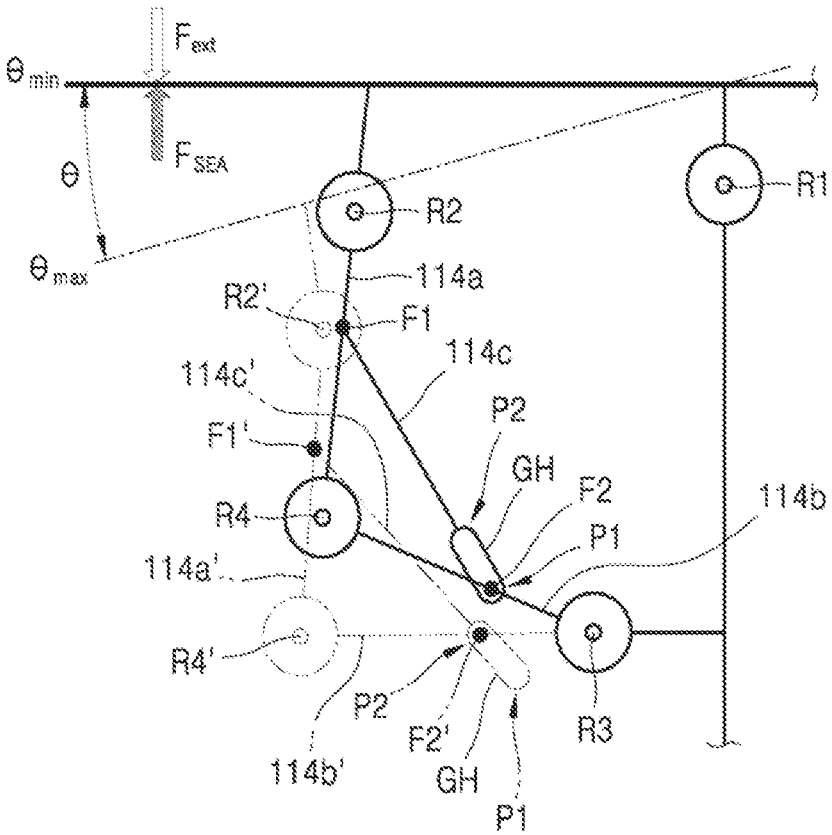
Figure 5:
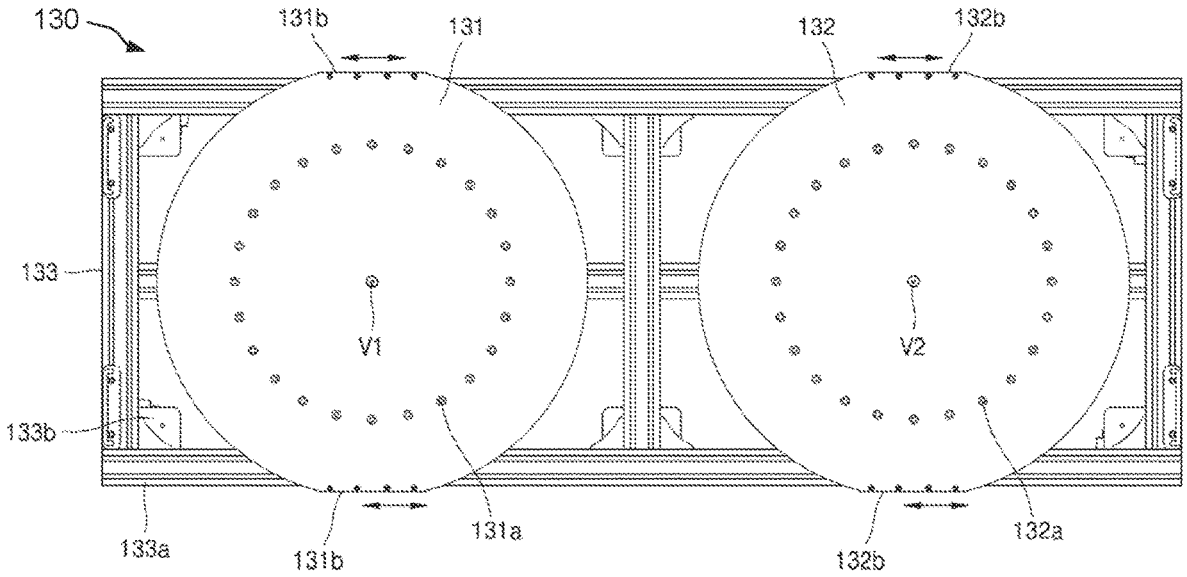
FIG. 5 is a top view illustrating a base frame.

FIG. 2 is a perspective view illustrating the exercise apparatus for lumbar stabilization according to the embodiment of the present invention. FIG. 3 is a side view illustrating the first sub-antigravity module. FIGS. 4*a* and 4*b* are simplified conceptual diagrams illustrating the operation of the first sub-antigravity module of FIG. 3. FIG. 5 is a top view illustrating a base frame.

Referring to FIG. 2, the exercise apparatus for lumbar stabilization 100 according to the embodiment of the present invention may include a first sub-antigravity module 110 and a second sub-antigravity module 120, which apply an antigravity force to a body, and a base frame 130 for supporting the first and second sub-antigravity modules 110 and 120.

The first sub-antigravity module 110 may apply a predetermined force (antigravity force) to an upper body in a direction opposite to gravity. The second sub-antigravity module 120 may apply a predetermined force (antigravity force) to a lower body in a direction opposite to gravity.

Although the first and second sub-antigravity modules 110 and 120 will be described later, they may include the substantially same components but differ from each other in that they are installed on first and second rotating plates 131 and 132, respectively, to apply an antigravity force to an upper or lower body.

Therefore, only the first sub-antigravity module 110 will be described hereinafter for convenience of description. A detailed description of the second sub-antigravity module 120 will be omitted, but the detailed description of the first sub-antigravity module 110 will be used as it is.

However, in the drawings, the components of the first sub-antigravity module 110 will be designated by reference numerals such as 111 and 112, and the components of the second sub-antigravity module 120 will be designated by reference numerals such as 121 and 122. In this case, it is found that the components designated by reference numerals 111 and 121 are the same as each other and the components designated by reference numerals 112 and 122 are also the same as each other.

Specifically, referring to FIGS. 2 to 4*b*, the first sub-antigravity module 110 may include a cushion 111 for supporting the upper body, a support 112 for supporting the cushion 111, an elastic actuator 113 for applying an antigravity force to the cushion 111, and a restraint link 114 for connecting the cushion 111 and the support 112 while defining a range of rotation of the cushion 111.

The cushion 111 is a component on which the upper body rests during lumbar stabilization exercise, and may rotate about a horizontal rotary shaft R1 as illustrated in FIGS. 4*a* and 4*b*. The rotational motion of the cushion 111 will be described in detail again after all the components of the first sub-antigravity module 110 are described below.

The support 112 may include a horizontal support 112*a* that is rotatably installed on the first rotating plate 131, a vertical support 112*b* that connects the first rotating plate 131 and the cushion 111 and is linked to the cushion 111 so that the cushion 111 is rotatable about the horizontal rotary shaft R1 extending horizontally, and a connecting support 112*c* that connects the horizontal support 112*a* and the vertical support 112*b*.

In detail, the horizontal support 112*a* may include a rotation center part 112*a*_1 that accommodates a first vertical rotary shaft V1 (FIG. 2), and may rotate with respect to the first rotating plate 131 along with the rotation center part 112*a*_1 rotating about the first vertical rotary shaft V1.

The elastic actuator 113 may connect the first rotating plate 131 and the cushion 111, and may apply an antigravity force to the cushion 111. In detail, referring to FIG. 3, the elastic actuator 113 may include a motor 113*a* that provides a driving force for rotating a screw shaft SA, a nut member 113*b* that is coupled to the outer peripheral surface of the screw shaft SA to be movable along the screw shaft SA and is linked to the cushion 111 (see R5 in FIG. 3), and an elastic member 113*c* that is installed to the nut member 113*b* to provide a predetermined elastic force between the nut member 113*b* and the cushion 111.

The elastic actuator 113 may further include a first displacement measuring sensor 113*d* whose one end is installed to the motor 113*a* while the other end thereof is installed adjacent to the linking position R5 between the nut member 113*b* and the cushion 111, to measure the displacement of the elastic actuator 113. The elastic actuator 113 may further include a second displacement measuring sensor 113*e* installed to the elastic member 113*c* to measure the displacement of the elastic member 113*c*.

Specifically, the antigravity force generated by the elastic actuator 113 may be output by controlling the displacement of the elastic actuator 113 and the displacement of the elastic member 113*c* by the rotational motion of the cushion 111. Thus, information on the displacement of the elastic actuator 113 and the displacement of the elastic member 113*c* measured by the respective first and second displacement measuring sensors 113*d* and 113*e* may be collected and transmitted back to the elastic actuator 113 by a separate control unit (not illustrated) to be reflected in the antigravity force output by the elastic actuator 113.

The restraint link 114 may include a first link 114*a* that connects the cushion 111 and the connecting support 112*c* and is linked, at one end thereof, to the cushion 111 (see R2 in FIG. 3), a second link 114*b* whose one end is linked to the connecting support 112*c* (see R3 in FIG. 3) while the other end thereof is linked to the other end of the first link 114*a* (see R4 in FIG. 3), and a third link 114*c* whose one end is rotatably connected to a first fixed shaft F1 installed on the first or second link 114*a* or 114*b* while the other end thereof is connected to a second fixed shaft F2 installed on the first or second link 114*a* or 114*b*, the third link 114*c* having a guide hole GH formed to accommodate the second fixed shaft F2 to impart a degree of freedom to the second fixed shaft F2.

Here, installing one of the first and second fixed shafts F1 and F2 on either the first link 114*a* or the second link 114*b* means that the second fixed shaft F2 may be formed on the second link 114*b* if the first fixed shaft F1 is formed on the first link 114*a* as illustrated in FIG. 3, whereas the second fixed shaft F2 may be formed on the first link 114*a* if the first fixed shaft F1 is formed on the second link 114*b* although not illustrated in the drawings.

Here, the guide hole GH is formed at a position where the second fixed shaft F2 is formed. Therefore, FIG. 3 illustrates a state in which the guide hole GH is formed toward the second link 114*b*, but the embodiments of the present invention are not limited thereto. For example, if the second fixed shaft F2 is formed on the first link 114*a*, the guide hole GH may be formed toward the first link 114*a*. However, a case will be described below where the first fixed shaft F1 is formed on the first link 114*a*, the second fixed link F2 is formed on the second link 114*b*, and the guide hole GH of the third link 114*c* is formed toward the second link 114*b* as illustrated in FIG. 3.

In detail, referring to FIGS. 4*a* and 4*b*, the second fixed shaft F2 is movable between a first position P1 and a second position P2 in the guide hole GH. For example, when the second fixed shaft F2 is placed at the first position P1 (see FIGS. 4*a* and 4*b*), the cushion 111 may horizontally support the upper body. On the other hand, when the second fixed shaft F2 is placed at the second position P2 (see FIG. 4*b*), the cushion 111 may be rotated by a predetermined angle ($\theta_{min}>\theta_{max}$) toward the base frame 130 about the position at which the cushion 111 and the vertical support 112*b* are linked to each other, i.e., about the horizontal rotary shaft R1.

Referring to FIG. 4*b*, in the case where the second fixed shaft F2 is placed at the second position P2 as described above, namely, the cushion 111 is rotated by a predetermined angle ($\theta_{min}>\theta_{max}$) toward the base frame 130 about the horizontal rotary shaft R1, assuming that the force of gravity applied to the cushion 111 by the body is $F_{ext}$, the antigravity force applied from the elastic actuator 113 to the cushion 111 may be defined as $F_{SEA}$.

This means that the restraint link 114 functions to limit the range of rotation of the cushion 111. That is, the restraint link 114 may limit the range of rotation of the cushion 111 from $\theta_{min}$ to $\theta_{max}$.

Due to the presence of the restraint link 114, it is possible to implement stiffness beyond the stiffness inherent in the elastic member 113*c* of the elastic actuator 113. For example, when the antigravity force $F_{SEA}$ applied to the cushion 111 by the elastic actuator 113 is greater than the external force $F_{ext}$ applied to the cushion 111 due to the weight of the body, the cushion 111 may function as a type of rigid body. In contrast, when the external force $F_{ext}$ exceeds the antigravity force $F_{SEA}$ that can be output by the elastic actuator 113, the rotational motion of the cushion 111 may not be limited.

However, due to the presence of the restraint link 114, the range of rotation of the cushion 111 may be limited from $\theta_{min}$ to $\theta_{max}$ even though the external force $F_{ext}$ exceeds the antigravity force $F_{SEA}$ that can be output by the elastic actuator 113.

Therefore, according to the exercise apparatus for lumbar stabilization 100 configured as described above, it is possible to control the antigravity force $F_{anti\text{-}g}$ applied to the cushion 111 through the elastic actuator 113 and the restraint link 114. In addition, when a patient's waist joint (not illustrated) is positioned on the cushion 111 to which the antigravity force $F_{anti\text{-}g}$ is applied, it is possible to control the torque (see $\tau_{lb}$ in FIG. 1) applied to the patient's waist joint.

Accordingly, it is possible to apply a lower load than gravity (gravity minus antigravity load) to a patient's specific muscle associated with lumbar stability, which enables the patient to actively and minutely control his/her own body. Consequently, the exercise apparatus for lumbar stabilization according to the embodiment of the present invention can minimize the load applied to the spine and upper and lower limbs of the patient during lumbar stabilization exercise to implement the lumbar stabilization exercise with safety and effectiveness.

Referring to FIG. 5, the base frame 130 may include a first rotating plate 131 for supporting the first sub-antigravity module 110 to be rotatable about a first vertical rotary shaft V1 extending vertically, a second rotating plate 132 for supporting the second sub-antigravity module 120 to be rotatable about a second vertical rotary shaft V2 extending vertically, and a guide 133 for individually supporting the first and second rotating plates 131 and 132 to be movable horizontally.

In detail, the first rotating plate 131 may include a plurality of fixed coupling holes 131*a* spaced at regular intervals radially about the first vertical rotary shaft V1. The horizontal support 112*a* may include a rotation coupling part 112*a*_2 having a rotation coupling hole RH corresponding to the plurality of fixed coupling holes 131*a*, and a rotation fixing pin 112*a*_3 inserted into the rotation coupling part 112*a*_2 and an associated one of the fixed coupling holes 131*a* to limit the rotation of the horizontal support 112*a* relative to the first rotating plate 131.

In addition, the first rotating plate 131 may include a horizontal guide part 131*b* for accommodating a rail 133*a* formed on the side surface of the guide 133, and the horizontal guide part 131*b* may be formed to be movable horizontally along the rail 133*a*.

Here, the second rotating plate 132 may include the same components as those of the first rotating plate 131 described above. However, the second rotating plate 132 differs from the first rotating plate 131 in that the second rotating plate 132 is coupled to the second sub-antigravity module 120. Therefore, a detailed description of the second rotating plate 132 will be omitted below, but the description of the components of the first rotating plate 131 will be used as it is.

For example, the second rotating plate 132 may include fixed coupling holes 132*a* and a horizontal guide part 132*b*, and the fixed coupling holes 132*a* and the horizontal guide part 132*b* have the same structure as the fixed coupling holes 131*a* and the horizontal guide part 131*b* of the first rotating plate 131. In addition, the horizontal support 122*a* of the second sub-antigravity module 120 corresponding thereto may include a rotation coupling part 122*a*_2 and a rotation fixing pin 122*a*_3 as described above.

The guide 133 may include a plurality of rollers 133*a* for supporting the base frame 130 to be movable on the ground. Through such a structure, the exercise apparatus for lumbar stabilization 100 can be easily transported through the rollers 133*a*.

While the present invention has been described with respect to the embodiments illustrated in the drawings, it will be understood to those skilled in the art that such embodiments are by way of example only and various modifications and other equivalent embodiments may be made without departing from the spirit and scope of the invention. Therefore, the true technical scope of the present invention should be defined by technical ideas of the appended claims.

The invention claimed is:

1. An exercise apparatus for lumbar stabilization, comprising:

a first sub-antigravity module configured to apply a predetermined force to an upper body in a direction opposite to gravity;

a second sub-antigravity module configured to apply a predetermined force to a lower body in the direction opposite to gravity;

a base frame comprising a first rotating plate configured to support the first sub-antigravity module to be rotatable about a first vertical rotary shaft extending vertically and a second rotating plate configured to support the second sub-antigravity module to be rotatable about a second vertical rotary shaft extending vertically, wherein each of the first and second sub-antigravity modules comprises:

a cushion configured to support the upper or lower body;

a support comprising a horizontal support rotatably installed on the first or second rotating plate, a vertical support configured to connect the first or second rotating plate and the cushion and linked to the cushion so that the cushion is rotatable about a horizontal rotary shaft extending horizontally, and a connecting support configured to connect the horizontal support and the vertical support; and an elastic actuator configured to connect the first or second rotating plate and the cushion and to apply an antigravity force to the cushion.

2. The exercise apparatus according to claim 1, wherein the base frame comprises a guide configured to individually support the first and second rotating plates to be movable horizontally along the base frame.

3. The exercise apparatus according to claim 2, wherein:

each of the first and second rotating plates comprises a horizontal guide part configured to accommodate a rail formed on a side surface of the guide; and the horizontal guide part is formed to be movable horizontally along the rail.

4. The exercise apparatus according to claim 2, wherein the guide comprises a plurality of rollers configured to support the base frame to be movable on the ground.

5. The exercise apparatus according to claim 1, wherein each of the first and second sub-antigravity modules comprises a restraint link comprising a first link configured to connect the cushion and the connecting support, the first link having one end linked to the cushion, a second link with one end linked to the connecting support and a second end linked to a second end of the first link, and a third link with one end rotatably connected to a first fixed shaft installed on the first or second link and a second end connected to a second fixed shaft installed on the first or second link, the third link having a guide hole formed to accommodate the second fixed shaft to impart a degree of freedom to the second fixed shaft.

6. The exercise apparatus according to claim 5, wherein:

the second fixed shaft is movable between a first position and a second position in the guide hole;

when the second fixed shaft is placed at the first position, the cushion horizontally supports the upper or lower body; and when the second fixed shaft is placed at the second position, the cushion is rotated by a predetermined angle toward the base frame about a position at which the cushion and the vertical support are linked to each other.

7. The exercise apparatus according to claim 1, wherein:

the horizontal support comprises a rotation center part configured to accommodate the first or second vertical rotary shaft; and the horizontal support rotates with respect to the first or second rotating plate along with the rotation center part rotating about the first or second vertical rotary shaft.

8. The exercise apparatus according to claim 1, wherein:

each of the first and second rotating plates comprises a plurality of fixed coupling holes spaced at regular intervals radially about the first or second vertical rotary shaft; and the horizontal support comprises a rotation coupling part having a rotation coupling hole corresponding to the plurality of fixed coupling holes, and a rotation fixing pin inserted into the rotation coupling part and an associated one of the fixed coupling holes to limit rotation of the horizontal support relative to the first or second rotating plate.

9. The exercise apparatus according to claim 1, wherein the elastic actuator comprises:

a motor configured to provide a driving force for rotating a screw shaft;

a nut member coupled to an outer peripheral surface of the screw shaft to be movable along the screw shaft, and linked to the cushion; and an elastic member installed to the nut member to provide a predetermined elastic force between the nut member and the cushion.

10. The exercise apparatus according to claim 9, wherein the elastic actuator further comprises a first displacement measuring sensor with one end installed to the motor and a second end installed adjacent to a linking position between the nut member and the cushion, to measure a displacement of the elastic actuator.

11. The exercise apparatus according to claim 9, wherein the elastic actuator further comprises a second displacement measuring sensor installed to the elastic member to measure a displacement of the elastic member.

* * * * *